United States Patent [19]

Harris et al.

[11] Patent Number: 4,627,495

[45] Date of Patent: Dec. 9, 1986

[54] METHOD FOR STIMULATION OF WELLS WITH CARBON DIOXIDE OR NITROGEN BASED FLUIDS CONTAINING HIGH PROPPANT CONCENTRATIONS

[75] Inventors: Phillip C. Harris; Vincent G. Reidenbach, both of Duncan, Okla.; Pat T. Chisholm, Portland, Tex.

[73] Assignee: Halliburton Company, Duncan, Okla.

[21] Appl. No.: 719,669

[22] Filed: Apr. 4, 1985

[51] Int. Cl.[4] ..... E21B 43/267

[52] U.S. Cl. ..... 166/280; 166/308

[58] Field of Search ..... 166/271, 280, 281, 308, 166/309; 252/8.55 R

[56] References Cited

U.S. PATENT DOCUMENTS

| | | | |
|---|---|---|---|
| 3,108,636 | 10/1963 | Peterson . | |
| 3,195,634 | 7/1965 | Hill | 166/308 X |
| 3,310,112 | 3/1967 | Nielsen . | |
| 3,368,627 | 2/1968 | Hurst et al. . | |
| 3,396,107 | 8/1968 | Hill . | |
| 3,664,422 | 5/1972 | Bullen | 166/283 |
| 3,710,865 | 1/1973 | Kiel | 166/308 |
| 3,722,595 | 3/1973 | Kiel | 166/308 |
| 3,799,266 | 3/1974 | Kiel | 166/308 |
| 3,842,910 | 10/1974 | Zingg et al. | 166/308 X |
| 3,898,165 | 8/1975 | Ely et al. | 166/283 X |
| 3,954,626 | 5/1976 | Greminger, Jr. et al. | 166/308 X |
| 3,980,136 | 9/1976 | Plummer et al. | 166/280 |
| 4,480,696 | 11/1984 | Almond et al. | 166/280 X |
| 4,488,975 | 12/1984 | Almond | 166/308 X |
| 4,519,455 | 5/1985 | Holtmyer et al. | 166/308 X |
| 4,553,601 | 11/1985 | Almond et al. | 166/308 |

*Primary Examiner*—George A. Suchfield
*Attorney, Agent, or Firm*—Robert A. Kent

[57] ABSTRACT

The present invention relates to a method of fracturing subterranean formations and placing proppant material in the created fracture utilizing carbon dioxide or nitrogen containing fluid. An aqueous liquid-liquid carbon dioxide emulsion fluid is prepared having an internal phase ratio in the range of from about 50 to in excess of about 96 percent and introduced into the subterranean formation to be fractured. The emulsion is heated by the formation to a temperature above the critical temperature of carbon dioxide and the carbon dioxide is caused to be converted to a vapor whereupon the emulsion becomes a foam. The volume of liquid carbon dioxide is adjusted as the volume of proppant material varies to at least substantially maintain a constant internal phase ratio in the treatment fluid. When nitrogen is utilized, a foam is produced on the surface by admixing gaseous nitrogen with the gelled fluid. The formation is fractured by the treatment fluid and the proppant is placed in the created fracture. The fluid having maintained therein substantially a constant internal phase ratio is capable of transporting greater quantities of proppant than foams having a comparable quality.

32 Claims, No Drawings

METHOD FOR STIMULATION OF WELLS WITH CARBON DIOXIDE OR NITROGEN BASED FLUIDS CONTAINING HIGH PROPPANT CONCENTRATIONS

BACKGROUND OF THE INVENTION

1. Field of the Invention:

This invention relates to a method of fracturing subterranean formations penetrated by a well bore utilizing carbon dioxide or nitrogen based fluids in which it is possible to carry high proppant concentrations. More particularly, this invention relates to a method of fracturing a subterranean formation with a two-phase treatment fluid capable of transporting high concentrations of a proppant by maintaining a constant internal phase ratio in said treatment fluid.

2. Description of the Prior Art:

The treatment of subterranean formations penetrated by a well bore to stimulate the production of hydrocarbons therefrom or the ability of the formation to accept injected fluids has long been known in the art. One of the most common methods of increasing productivity of a hydrocarbon-bearing formation is to subject the formation to a fracturing treatment. This treatment is effected by injecting a liquid, gas or two-phase fluid which generally is referred to as a fracturing fluid down the well bore at sufficient pressure and flow rate to fracture the subterranean formation. A proppant material such as sand, fine gravel, sintered bauxite, glass beads or the like can be introduced into the fractures to keep them open. The propped fracture provides larger flow channels through which an increased quantity of a hydrocarbon can flow, thereby increasing the productive capability of a well.

A traditional fracturing technique utilizes a water or oil-based fluid to fracture a hydrocarbon-bearing formation.

Another successful fracturing technique has been that known as "foam fracturing". This process is described in, for example, U.S. Pat. No. 3,980,136. Briefly, that process involves generation of a foam of a desired "Mitchell quality" which then is introduced through a well bore into a formation which is to be fractured. The composition of the foam is such that the Mitchell foam quality at the bottom of the well is in the range of from about 0.53 to 0.99. Various gases and liquids can be used to create the foam, but foams generally used in the art are made from nitrogen and water, in the presence of a suitable surfactant. The pressure at which the foam is pumped into the well is such that it will cause a fracture of the hydrocarbon-bearing formation. Additionally, the foam comes out of the well easily when the pressure is released from the well head, because the foam expands when the pressure is reduced.

Yet another fracturing technique has been that utilizing a liquified, normally gaseous fluid. U.S. Pat. No. 3,195,634, for example, discloses a method for treating a subterranean formation penetrated by a well bore with a composition comprising a liquid-liquid mixture of carbon dioxide and water. The carbon dioxide is present in an amount equivalent to from about 300 to about 1500 SCF at 80° F. and 14.7 psia per 42 gallons of water. The composition is injected into the formation under sufficient pressure to fracture the formation. The composition can include gelling agents and proppant materials.

Upon pressure release at the well head, the liquid carbon dioxide vaporizes and flows from the formation.

U.S. Pat. No. 3,310,112 discloses a method of fracturing a subterranean formation penetrated by a well bore comprising introduction of a mixture of liquid carbon dioxide and a propping agent slurried in a suitable vehicle into the well bore at a pressure sufficient to fracture the formation. The liquid carbon dioxide is present in an amount sufficient to provide at least five volumes of carbon dioxide per volume of slurried propping agent. After injection of the mixture of liquid carbon dioxide containing the propping agent slurried in a suitable vehicle, the pressure on the well bore is released. The liquid carbon dioxide normally is heated sufficiently by the formation that upon pressure release, the liquid changes to a gas. A substantial portion of the carbon dioxide then leaves the well and forces or carries out with it an appreciable amount of the oil or aqueous vehicle utilized to transport the proppant.

U.S. Pat. No. 3,368,627 discloses a method of treating a formation penetrated by a well bore which consists essentially of injecting down the well bore a fluid azeotropic mixture which has a critical temperature sufficiently high or a critical pressure sufficiently low to remain a liquid at the temperature and pressure existing during injection and treatment of the formation. The fluid mixture has critical properties such that a substantial portion of the injected fluid is converted to a gas upon a release of the pressure applied to the liquid during injection into the formation. The fluid mixture consists essentially of carbon dioxide and at least one $C_2$ to $C_6$ hydrocarbon.

U.S. Pat. No. 3,664,422 discloses a method of treating a subsurface earth formation penetrated by a well bore comprising injection of a liquified gas together with a gelled alcohol into the formation at a pressure sufficient to fracture the formation. The liquified gas is returned from the formation by vaporization following pressure reduction on the well bore. The gelled alcohol is removed by vaporization during subsequent production from the well leaving only the broken gelling agent in the formation.

It would be desirable to provide a method by which a viscous fluid can be created from carbon dioxide and an aqueous fluid which is stable over a broad temperature range and is capable of carrying high concentrations of proppant into a subterranean formation.

SUMMARY OF THE INVENTION

The present invention relates to a method for forming fractures in subterranean formations penetrated by a well bore and transporting increased concentrations of proppant material into the formation penetrated by the well bore. The method permits increased penetration of the formation by the fluids together with low fluid leak-off to the formation and the ability to carry high concentrations of proppant material without proppant settling in the fracturing fluids. The fracturing fluids of the invention are liquid-liquid emulsions of liquified carbon dioxide and an aqueous fluid at surface conditions, and the emulsion is converted into a gas-in-liquid foam upon heating in the formation to a temperature above the critical temperature of the carbon dioxide. The fracturing fluids comprise up to in excess of 96 percent by volume carbon dioxide and, preferably, may comprise from about 10 to about 96 percent by volume carbon dioxide. The fracturing fluid contains a surfactant which at least partially stabilizes the emulsion and foam which is produced against breakdown and also includes gelling agents for additional stability and the like. Alternatively, the fluids are nitrogen based foams which can comprise up to about 96 percent nitrogen gas by volume and, preferably, may comprise from about 10 to about 96 percent by volume nitrogen.

DESCRIPTION OF THE PREFERRED EMBODIMENT

In the practice of one embodiment of the present invention, a fracturing fluid is prepared by admixing, under suitable conditions of temperature and pressure, a quantity of liquified carbon dioxide with an aqueous liquid and a surfactant to form a liquid-liquid emulsion.

The liquified carbon dioxide is provided from a surface vessel at a temperature and pressure sufficient to maintain the liquid conditions of the normally gaseous carbon dioxide, such as for example, a temperature of about 0° F. and a pressure of about 300 psia. The liquid carbon dioxide is admixed with the aqueous fluid in an amount sufficient to provide an initial volumetric ratio of liquid carbon dioxide to aqueous fluid in the range of from about 1:1 to about 20:1. Preferably, the initial ratio is in the range of from about 2:1 to about 18:1. The foam formed from the emulsion will have an initial quality of from in excess of about 50 percent to in excess of about 96 percent. The term "quality" as used herein is intended to mean the percentage of the volume of carbon dioxide at the existing temperature and pressure within the formation to the volume of the carbon dioxide plus the volume of the aqueous fluid and any other liquid components present in the fracturing fluid.

The composition of the present invention will have an internal phase ratio of from about 50 to in excess of about 96 percent. The "internal phase ratio" as used herein is intended to mean the ratio expressed in percent of the total volume of the internal phase of the fluid composition comprising liquids, solids or vapors to the total volume of the fluid composition comprising both the internal phase and the external or continuous phase at the existing temperature and pressure within the formation which is to be treated.

The aqueous liquid can comprise any aqueous solution which does not adversely react with the constituents of the fracturing fluid, the subterranean formation or the hydrocarbons present therein. The aqueous liquid can comprise, for example, water, a potassium chloride solution, water-alcohol mixtures or the like.

The liquid carbon dioxide and aqueous liquid can be admixed in a pressurized mixer or other suitable apparatus. In one preferred embodiment, the carbon dioxide and aqueous liquid are admixed by turbulent contact at a simple "T" connection in the fracturing fluid injection pipeline to form the emulsion. The emulsion will have a temperature below about the critical temperature of the carbon dioxide. The liquid-liquid emulsion is at least partially stabilized by the addition of a quantity of a selected surfactant. The surfactant comprises cationic, anionic, nonionic or amphoteric compounds, such as for example, betaines, sulfated or sulfonated alkoxylates, alkyl quaternary amines, alkoxylated linear alcohols, alkyl sulfonates, alkyl aryl sulfonates, $C_{10}$–$C_{20}$ alkyldiphenyl ether sulfonates and the like. The particular surfactant employed will depend upon the type of formation which is to be fractured. The surfactant is admixed with the emulsion in an amount of from about one-half to about 20 gallons per 1000 gallons of emulsion to provide a surfactant concentration of from about 0.05 percent to about 2.0 percent by weight. It is to be understood that larger quantities of the designated surfactants can be employed, however, such use is uneconomical. The surfactant, preferably, is admixed with the aqueous liquid prior to formation of the emulsion to facilitate uniform admixing and to assist in stabilizing the two phase structure of the emulsion.

The emulsion which is formed is characterized by a very fine cell size distribution or texture. The term "cell size" as used herein means the size of the gaseous or liquid carbon dioxide droplet which is surrounded by the aqueous fluid in the emulsion. The term "texture" as used herein means the general appearance of the distributed cells of gaseous or liquid carbon dioxide in the emulsion. The fine texture of the emulsion of the present invention assists in the transport of high concentrations of proppant material. The fine texture of the emulsion also results in the formation of a foam having a smaller cell size than otherwise would be possible such as by conventional foam generation methods in which the foam is generated on the surface and pumped into the subterranean formation.

In one preferred embodiment, a gelling agent is admixed with the aqueous liquid prior to formation of the emulsion. The gelling agent can comprise, for example hydratable polymers which contain, in sufficient concentration and reactive position, one or more of the functional groups, such as, hydroxyl, cis-hydroxyl, carboxyl, sulfate, sulfonate, amino or amide. Particularly suitable such polymers are polysaccharides and derivatives thereof which contain one or more of the following monosaccharide units: galactose, mannose, glucoside, glucose, xylose, arabinose, fructose, glucuronic acid or pyranosyl sulfate. Natural hydratable polymers containing the foregoing functional groups and units include, but are not limited to, guar gum and derivatives thereof, locust bean gum, tara, konjak, tamarind, starch, cellulose and derivatives thereof, karaya, xanthan, tragacanth and carrageenan.

Hydratable synthetic polymers and copolymers which contain the above-mentioned functional groups and which can be utilized in accordance with the present invention include, but are not limited to, polyacrylate, polymethacrylate, polyacrylamide, maleic anhydride methylvinyl ether copolymers, polyvinyl alcohol, and polyvinylpyrrolidone.

Various compounds can be utilized with the above-mentioned hydratable polymers in an aqueous solution to inhibit or retard the hydration rate of the polymers, and therefore, delay a viscosity increase in the solution for a required period of time. Depending upon the particular functional groups contained in the polymer, different inhibitors react with the functional groups to inhibit hydration. For example, inhibitors for cis-hydroxyl functional groups include compounds containing multivalent metals which are capable of releasing the metal ions in an aqueous solution, borates, silicates, and aldehydes. Examples of the multivalent metal ions are chrominum, zirconium, antimony, titanium, iron (ferrous or ferric), tin, zinc and aluminum. Inhibitors for hydroxyl functional groups include mono- and di-functional aldehydes containing from about 1 to about 5 carbon atoms and multivalent metal salts that form hydroxide. Multivalent metal salts or compounds can be utilized as inhibitors for the hydroxyl functional groups. Inhibitors for amides include aldehydes and multivalent metal salts or compounds. Generally, any compound can be used as an inhibitor for a hydratable polymer if the compound reacts or otherwise combines with the polymer to crosslink, form a complex or otherwise tie-up the functional groups of the polymer whereby the rate of hydration of the polymer is retarded. The inhibitor, when present, is admixed with the aqueous liquid in an amount of from about 0.001 to about 10.0 percent by weight of the aqueous liquid.

As stated above, the functional groups contained in the polymer or polymers utilized must be in sufficient concentration and in a reactive position to interact with the inhibitors. Preferred hydratable polymers which yield high viscosities upon hydration, that is, apparent viscosities in the range of from about 10 centipoise to about 90 centipoise at a concentration in the range of from about 10 lbs/1000 gals. to about 80 lbs/1000 gals. in water, are guar gum and guar derivatives such as hydroxypropyl guar, hydroxyethylguar, and carboxymethylguar, cellulose derivatives such as hydroxyethylcellulose, carboxymethylcellulose, and carboxymethylhydroxyethylcellulose, locust bean gum, carrageenan gum and xanthan gum. Xanthan gum is a biopolysaccharide produced by the action of bacteria of the genus Xanthonomas. The hydration of the polymers can be inhibited or retarded by various inhibitors present in the aqueous liquid. The reversal of the inhibition of such polymers by the inhibitors can be accomplished by a change in the pH of the solution or by heating the solution to an appropriate temperature, generally above about 140° F.

Examples of some of the inhibitors which can be utilized depending upon the particular polymer or polymers used in the aqueous liquid are sodium sulfite-sodium dichromate, aluminum sulfate, titanium triethanolamine chelate, basic potassium pyroantimonate, zinc chloride, iron chloride, tin chloride, zirconium oxychloride in hydrochloric acid solution, sodium tetraborate and glyoxal. The gelled aqueous liquid thus formed can be used to transport significant quantities of proppant material to the point of mixing with the carbon dioxide. The proppant material can comprise, for example, sand, graded gravel, glass beads, sintered bauxite, resin-coated sand or the like.

Under differing conditions of pH or temperature, the inhibitors identified above may function as cross-linking agents to increase the viscosity of the gelled aqueous liquid by crosslinking the gelling agents after hydration. The crosslinking agent, when present, is admixed with the aqueous gelled fluid in an amount sufficient to effect crosslinking of the hydrated gelling agent. The crosslinking agent can be present in an amount of from about 0.001 to about 3.0 percent by weight of the aqueous fluid.

The proppant material is admixed with the gelled aqueous liquid prior to admixing with the liquid carbon dioxide. The admixing of the proppant material with the gelled liquid can be effected in any suitable mixing apparatus, such as for example, a batch mixer, a continuous mixer or the like.

The amount of proppant material admixed with the gelled aqueous liquid may be varied to provide the desired amount of proppant in the two-phase fluid introduced into the formation. The proppant material can be admixed with the aqueous liquid in an amount of from about zero pounds of proppant per gallon of aqueous liquid up to as many pounds of proppant material per gallon as may be pumped. Depending upon formation reservoir conditions, the amount of proppant material transported by the two-phase fluid within the subterranean formation generally can be in the range of from about ½ pound to in excess of about 20 pounds per gallon of two-phase fracturing fluid without a screen out occurring. The size and type of the proppant material may be varied during the treatment of the formation to achieve desired proppant distributions in the created fracture.

Typically, while it is desirable to introduce the maximum amount of proppant material possible into a fracture formed in a subterranean formation, the proppant normally is introduced in a staged sequence of successively increased quantities of proppant material per gallon of the transporting treatment fluid introduced into a fracture. It is desirable to introduce as much proppant material into a created fracture as possible to maximize the propped width of the fracture whereby the fracture flow capacity of the created fracture is maximized. That is, in general, the greater the quantity of proppant material placed in a fracture, the greater the flow capacity of the fracture will be upon fracture closure upon the proppant at the conclusion of the formation treatment. Initially, in a fracturing process, the treatment fluid must be introduced into the formation in an amount sufficient to establish a fracture in the subterranean formation. Such a fracture generally will have a wedge-shaped geometry tapered from the wellbore. The proppant initially is introduced into the created fracture at a low concentration in the transport fluid because of the generally higher fluid-loss to the formation experienced by the initially introduced treatment fluid. If the proppant material is introduced in too great a quantity initially, the fluid-loss to the formation from the treatment fluid may be so great as to cause a "sand-out" by premature deposition of the proppant from the treatment fluid resulting in blockage of the fracture. The initially introduced fluid desirably establishes some form of fluid-loss control whereby successively larger quantities of proppant material can be introduced into the fracture with the subsequently injected treatment fluid.

It has been determined that the viscosity of the fluid composition of the present invention increases as the quality of the fluid increases. Previously, it was considered the greater the viscosity of a fluid, generally, the greater is the quantity of proppant material that can be transported by the fluid. The quality of the fluid corresponds directly to the internal phase ratio when the internal phase comprises merely vapors or liquids. Surprisingly, it has been discovered that when the quality of the fluid is controllably reduced and a proppant is added to the fluid composition, the proppant also functions as an additional internal phase and results in a substantial maintenance of the fluid viscosity whereby the proppant is retained in suspension in the fluid and caused to enter the fracture in the formation substantially without premature settling or a sand-out occurring in the well bore penetrating the formation even though the quality has been lowered.

The fracturing fluid of the present invention is introduced into the well bore which penetrates the subterranean formation to be treated at a temperature below the critical temperature of the carbon dioxide and at a pressure above the critical pressure of the carbon dioxide. The initial viscosity of the liquid-liquid emulsion comprising the fracturing fluid is such that the fluid is easily pumped through the well bore, however, the viscosity of the fluid still is sufficient to support a significant quantity of proppant material.

As the fracturing fluid is introduced into the subterranean formation, the fluid slowly is heated to a temperature above the critical temperature of the carbon dioxide. Surprisingly, it has been found that when the liquid-liquid emulsion is heated to a temperature above the critical temperature of the carbon dioxide which may occur either during passage through the well bore penetrating the formation or after actual entry into the zone in the formation to be treated, the fluid substantially maintains its viscosity and undergoes conversion into a foam. The foam is substantially stabilized by the presence of the surfactant and the gelling agent present in the fracturing fluid. As the liquid carbon dioxide undergoes conversion to a gas, a slight increase in the volume of the carbon dioxide is found to occur. The term "gas" as used herein means a fluid at a temperature equal to or above the critical temperature of the fluid while maintained at any given pressure. Upon conversion of the liquid-liquid emulsion of the present invention to a foam, the foam is found to be substantially stabilized and it continues to transport the proppant material into the fracture formed in the subterranean formation by the foamed fracturing fluid with at least substantially the same effectiveness as a gelled liquid. The foam has been found to have a viscosity immediately after formation which is substantially the same as the viscosity of the liquid-liquid emulsion. Further, the foam substantially reduces any fluid leak-off to the formation that otherwise would occur if only a liquid fracturing fluid was utilized to treat the formation. The low fluid-loss characteristics of the fracturing fluid of the present invention results in a greater volumetric efficiency for a given volume and injection rate of the fracturing fluid in comparison to liquid fracturing fluids.

In accordance with the method of the present invention, as the proppant material is admixed with the gelled aqueous liquid, the volume of liquid carbon dioxide desired at the temperature and pressure conditions of the formation to be treated which is admixed with the gelled fluid is reduced by the volume of the proppant material introduced into the fluid composition whereby a constant internal phase ratio is maintained. The reduction may be effected in a sequential manner or continuously whereby a substantially constant internal phase ratio is maintained. As previously indicated, it now has been discovered that by maintaining a substantially constant internal phase ratio during placement of the proppant in the fracture produced by use of the carbon dioxide based fluid of the present invention that substantially higher proppant concentrations can be achieved in the fluid without premature settling or "sand-outs" occurring in the well bore and that substantially constant downhole injection rates are maintained. Preferably, the initial internal phase ratio of the treatment fluid is at least about 60 percent and, most preferably, at least about 70 percent. The foam quality will vary substantially during the treatment as the injection rate of proppant is increased. The quality of the fluid at the conclusion of the injection of proppant material may be in the range of from at least about 10 to about the maximum quality of the fluid while the internal phase ratio has been maintained substantially constant during injection of the proppant material.

As is known, it is highly desirably to maintain a constant volumetric injection rate to permit control of the pressure level experienced during treatment fluid injection so that the well head pressure can be controlled. The method of the present invention provides such control by permitting maintenance of substantially constant injection rates under the temperature and pressure conditions of the formation without undesirable declines in the capability of the fluid to transport proppant material.

After the introduction of the full amount of the calculated or estimated volume of fracturing fluid necessary to fracture the formation and transport the desired quantity of proppant material into the created fracture, the well bore is shut-in for a period of time sufficient to permit stabilization of the subterranean formation. In one embodiment, the well is shut-in for a period of time to permit the formation to at least partially close upon the proppant material and stabilize the fracture volume. The shut-in period can be from several minutes to in excess of about 12 hours and, preferably, is in the range of from about 1 to 2 hours. After the subterranean formation has stabilized, the well is opened under controlled conditions and the pressure drop in the well bore causes the foam to break. The carbon dioxide gas then moves from the formation into the well bore and exits the well bore at the surface. The gas carries a substantial portion of the liquids present in the fracturing area from the formation which leaves the formation and well clean and ready for the commencement of production.

The terms "stable" or "stabilized" as used herein with regard to the emulsions and foams of the present invention means the physical and functional properties of the fluid remain substantially unchanged for a period of time sufficient to permit the described formation treatment to be effected.

When nitrogen gas is utilized in the fluid of the present invention, the nitrogen gas is admixed with the gelled fluid to which the previously identified surfactants have been added together with the proppant material. The nitrogen gas is admixed with the gelled fluid by contacting the gas and gelled fluid in a foam generator. The foam generator may comprise a device as simple as a "T" connection in the fracturing fluid injection pipeline or any other suitable apparatus. Initially, sufficient nitrogen gas will be admixed with the gelled fluid to provide both a quality and internal phase ratio in excess of about 50 percent and, preferably, 60 percent and, most preferably, in excess of about 70 percent. Thereafter, as increased quantities of proppant material are admixed with the gelled fluid, the volume of nitrogen gas at the temperature and pressure of the formation undergoing treatment is reduced by an amount substantially equal to the volume of the proppant material that is admixed with the fluid. This reduction in nitrogen gas volume results in the internal phase ratio of the foamed fluid being substantially maintained at the desired level for the treatment while the foam quality may decline significantly.

The foam quality may decline during the treatment to a level in the range of from about 10 to just below the maximum quality of the nitrogen foam.

The foamed fluid is introduced into the subterranean formation to be treated at a rate and pressure sufficient to create at least one fracture in the formation. After all the desired proppant material has been introduced into the fracture, the well is shut-in for a period of time sufficient to permit the fracture to at least begin to close upon the proppant material. Thereafter, the well is opened to flow back the treatment fluid to effect well clean-up.

It has been found that, as previously indicated in regard to the carbon dioxide based fluids, the described surfactants substantially stabilize the nitrogen gas foam that is produced in accordance with the present invention. As the volume of gas is reduced and the proppant material concentration levels increase in the fluid, the viscosity of the foamed fluid substantially is maintained whereby the proppant material is retained in suspension without premature settling and caused to enter the fracture in the formation created by the foamed fluid.

It is to be understood that while reference has been made to "substantially maintaining the internal phase ratio" during the treatment, this is not intended to mean that the internal phase ratio may not increase during the treatment. It is merely intended to mean that the internal phase ratio is substantially maintained without the significant decline that occurs in the quality of the treatment during performance of the method whereby the apparent viscosity of the treatment fluid is maintained at a level sufficient to support the proppant material without premature settling.

To further illustrate the method of the present invention, and not by way of limitation, the following examples are provided.

EXAMPLE I

A fracturing treatment is performed on a well in the Red Fork Formation in Oklahoma. The well is perforated at a level of about 7000 feet. The formation has a permeability of about 0.10 millidarcy and a porosity of about 10 percent. The bottom hole temperature is about 170° F. The treatment is effected by pumping the fracturing fluid through 2.441-inch tubing positioned in the well bore.

A pad of 25,000 gallons of the liquid-liquid emulsion fluid of the present invention comprising two percent potassium chloride water gelled with 40 pounds of hydroxypropylguar per 1000 gallons is introduced into the formation. The potassium chloride is used as a water treating agent to prevent clay swelling in the formation. The pad has an internal phase ratio of 70 percent and a quality of 70. The emulsion contains about 4 gallons of an anionic surfactant per 1000 gallons of water. The surfactant comprises an ammonium salt of a sulfated linear $C_{12}$ to $C_{14}$ alcohol ethoxylated with 3 moles of ethylene oxide. Treating fluid of the same general composition of the pad together with proppant material comprising 20/40 mesh (U.S. Sieve Series) sand then is introduced into the tubing. The quantity of proppant material is sequentially increased in the treatment fluid to prop the created fracture. As the quantity of proppant in the treatment fluid is increased, the volume of liquid carbon dioxide admixed with the fluid is reduced by an amount substantially equal to the volume of the proppant whereby a substantially constant internal phase ratio is maintained and a substantially constant rate of fluid injection of about 12 barrels per minute is maintained into the well bore. The sequential treatment is more clearly described by review of the following Table I.

TABLE I

| Stage | Emulsion Liquid Volume (Gallons) | Flow Rate to Point of Mixing of Gel & Proppant (BPM) | Flow Rate to Point of Mixing of Liquid $CO_2$ (BPM) | Proppant Concentration (Lb./Gal.) | Internal Phase Ratio (%) | Foam Quality |
|---|---|---|---|---|---|---|
| Pad | 25,000 | 3.6 | 8.2 | 0 | 70 | 70 |
| 1 | 5,000 | 4.0 | 7.8 | 1.0 | 70 | 69 |
| 2 | 5,000 | 4.4 | 7.4 | 2.0 | 70 | 68 |
| 3 | 10,000 | 4.8 | 7.0 | 3.0 | 70 | 66 |
| 4 | 10,000 | 5.2 | 6.7 | 4.0 | 70 | 65 |
| 5 | 10,000 | 5.5 | 6.4 | 5.0 | 70 | .64 |
| Flush | 1,606 | 3.6 | 8.2 | 0 | 70 | 70 |

The flush comprises the same fluid as the pad treatment fluid. The entire volume of treatment fluid is introduced into the created fracture without a premature sand-out and while maintaining a constant injection rate whereby maximum wellhead treating pressure did not exceed 7810 psi at any point in the performance of the treatment.

EXAMPLE II

A fracturing treatment is performed on a well in the Morrow Formation in Texas. The well is perforated over an interval at a level of about 7725 to 7825 feet. The formation has a permeability of about 0.01 millidarcy and a porosity of about 8 percent. The bottom hole temperature is about 200° F. The treatment is effected by pumping the fracturing fluid through 7600 feet of 1.99-inch tubing and 2.375 by 4.9-inch annulus.

A pad of 23,500 gallons of the liquid-liquid emulsion of the present invention comprising two percent potassium chloride water gelled with 40 pounds of hydroxypropylguar per 1000 gallons is introduced into the formation. The pad has an internal phase ratio of 70 percent and a quality of 70. The emulsion contains about 5 gallons of the surfactant of Example I per 1000 gallons of water. Treating fluid of the same general composition of the pad together with sequentially greater quantities of proppant material comprising 20/40 mesh sand than is introduced into the created fracture in the formation.

As the quantity of proppant is increased in the treatment fluid, the volume of liquid carbon dioxide is reduced by an amount substantially equal to the volume of the proppant material whereby a substantially constant internal phase ratio is maintained. The treatment fluid injection rate is maintained constant at about 30 barrels per minute whereby the maximum wellhead treating pressure is maintained below about 4540 psi throughout the treatment. The sequence of the treatment is more clearly described by review of the following Table II.

TABLE II

| Stage | Emulsion Liquid Volume (Gallons) | Flow Rate to Point of Mixing of Gel & Proppant (BPM) | Flow Rate to Point of Mixing of Liquid $CO_2$ (BPM) | Proppant Concentration (Lb./Gal.) | Internal Phase Ratio (%) | Foam Quality |
|---|---|---|---|---|---|---|
| Pad | 23,500 | 9.0 | 19.8 | 0 | 70 | 70 |
| 1 | 8,100 | 11.5 | 17.7 | 2 | 70 | 67 |
| 2 | 13,500 | 13.6 | 15.9 | 4 | 70 | 65 |
| 3 | 15,000 | 15.4 | 14.2 | 6 | 70 | 62 |
| 4 | 17,500 | 17.0 | 12.8 | 8 | 70 | 59 |
| 5 | 20,000 | 18.4 | 11.5 | 10 | 70 | 56 |
| Flush | $CO_2$ displacement at 30 BPM with 70 quality foam | | | | | |

The entire volume of treating fluid is introduced into the created fracture without a sand-out. The viscosity of the liquid-liquid emulsion and foamed fluid remain substantially the same throughout the treatment even though the foam quality decreased from about 70 to about 56 during the treatment.

EXAMPLE III

A fracturing treatment was performed on the Wilcox formation in Texas. The well was perforated at a level of from about 7820 to 7830 feet. The formation has a permeability of about 0.8 millidarcy and a porosity of about 18 percent. The bottom hole temperature was about 210° F. The treatment was effected through 4.5-inch casing at a rate of about 20 barrels per minute.

A pad of 22,000 gallons of the liquid-liquid emulsion of the present invention comprising four percent potassium chloride water gelled with 50 pounds of hydroxypropylguar per 1000 gallons was introduced into the formation. The pad had an internal phase ratio of 70 percent and a quality of 70. The emulsion contained 7 gallons of the surfactant of Example I per 1000 gallons of water. The fluid also contained pH control agents, temperature stabilizers and a biocide. Treating fluid of the same general composition of the pad then was introduced into the tubing together with sequentially greater quantities of proppant material comprising 20/40 mesh Ottawa sand. As the quantity of proppant is increased in the treatment fluid, the volume of liquid carbon dioxide in the emulsion was reduced to maintain a substantially constant internal phase ratio. The preferred treatment sequence is more clearly described by review of the following Table III.

TABLE III

| Stage | Emulsion Liquid Volume (Gallons) | Flow Rate to Point of Mixing of Gel & Proppant (BPM) | Flow Rate to Point of Mixing of Liquid $CO_2$ (BPM) | Proppant Concentration (Lb./Gal.) | Internal Phase Ratio (%) | Foam Quality |
|---|---|---|---|---|---|---|
| Pad | 22,000 | 6.0 | 13.1 | 0 | 70 | 70 |
| 1 | 4,000 | 6.9 | 12.4 | 1.0 | 70 | 67 |
| 2 | 4,000 | 8.0 | 11.4 | 2.5 | 70 | 65 |
| 3 | 6,000 | 9.1 | 10.5 | 4.0 | 70 | 64 |
| 4 | 6,000 | 10.0 | 9.6 | 5.5 | 70 | 62 |
| 5 | 7,000 | 10.8 | 8.9 | 7.0 | 70 | 60 |
| 6 | 7,000 | 11.3 | 8.4 | 8.0 | 70 | 58 |
| 7 | 4,000 | 11.8 | 8.0 | 9.0 | 70 | 57 |
| Flush | Displacement at 20 BPM with 70 quality foam | | | | | |

The entire volume of treating fluid was introduced into the created fracture without premature settling of the proppant material even though the foam quality declined significantly during the treatment. The wellhead treating pressure did not exceed about 3500 psi throughout the treatment.

The treatment sequence which occurred during the performance of the method varied slightly from the preferred treatment in that the internal phase ratio increased during adjustment of the carbon dioxide volumetric flow rate in Stages 2–4, but returned to the desired level during later stages of the treatment.

While preferred embodiments of the invention have been described herein, changes or modifications in the method may be made by an individual skilled in the art, without departing from the spirit or scope of the invention as set forth in the appended claims.

What is claimed is:

1. A method of fracturing a subterranean formation penetrated by a well bore comprising:

admixing an aqueous liquid containing varying quantities of a proppant material and a gelling agent with liquid carbon dioxide and a surfactant which is present in an amount sufficient to form an emulsion, said emulsion having an internal phase ratio of from about 50 to in excess of about 96 percent;

adjusting the volume of carbon dioxide admixed with said aqueous liquid to at least substantially maintain said internal phase ratio constant as the quantity of said proppant is varied whereby the viscosity of said emulsion is caused to remain substantially unchanged as the quantity of said proppant varies;

introducing said emulsion into said well bore penetrating said subterranean formation at a temperature below the critical temperature of carbon dioxide and under sufficient pressure to maintain the carbon dioxide as a liquid and cause a fracture to be formed in said subterranean formation;

maintaining said emulsion within said formation for a sufficient time to permit said emulsion to be heated to a temperature above the critical temperature of carbon dioxide to form a foam from said emulsion, said foam having a viscosity immediately after formation which is substantially the same as the viscosity of the emulsion; and depositing at least a portion of said proppant material in said subterranean formation with said foam.

2. The method of claim 1 wherein said surfactant is present in a concentration in the range of from about 0.05 percent to about 2.0 percent by weight of the emulsion.

3. The method of claim 1 wherein said gelling agent comprises a hydratable polymer present in an amount of from about 10 pounds to about 80 pounds per 1000 gallons of aqueous fluid.

4. The method of claim 3 wherein said polymer comprises at least one member selected from the group consisting of guar gum and guar derivatives, locust bean gum, carrageenan gum, xanthan gum, cellulose derivatives, polyacrylates, polymethacrylates, polyacrylamides, polyvinyl pyrrolidone and copolymers of said compounds.

5. The method of claim 1 wherein said proppant is present in an amount of from about 0 pounds to about 20 pounds per gallon of emulsion.

6. A method of fracturing a subterranean formation penetrated by a well bore comprising:

admixing an aqueous liquid with varying quantities of a proppant material, liquid carbon dioxide and a surfactant to form an emulsion, said emulsion having an internal phase ratio of from about 50 to in excess of about 96 percent, said surfactant being present in said emulsion in an amount sufficient to substantially stabilize said emulsion;

adjusting the quantity of liquid carbon dioxide admixed with said aqueous liquid as said quantity of proppant material varies to at least substantially maintain said internal phase ratio constant in said emulsion containing said proppant;

introducing said emulsion into said well bore penetrating said subterranean formation at a temperature below the critical temperature of carbon dioxide and under sufficient pressure to maintain the carbon dioxide as a liquid;

maintaining said emulsion within said formation for a sufficient time to permit said emulsion to be heated to a temperature above the critical temperature of carbon dioxide to form a stabilized foam from said emulsion, said foam having a viscosity immediately after formation which is substantially the same as the viscosity of the emulsion;

contacting said formation with said emulsion or foam at a pressure sufficient to create at least one fracture in said subterranean formation; and depositing said proppant material in said fracture in said subterranean formation.

7. The method of claim 6 wherein said surfactant is present in a concentration in the range of from about 0.05 percent to about 2.0 percent by weight of the emulsion.

8. The method of claim 6 wherein said gelling agent comprises a hydratable polymer present in an amount of from about 10 pounds to about 80 pounds per 1000 gallons of aqueous liquid.

9. The method of claim 6 wherein said gelling agent comprises at least one member selected from the group consisting of guar gum and guar derivatives, locust bean gum, carrageenan gum, xanthan gum, cellulose derivatives, polyacrylates, polymethacrylates, polyacrylamides, polyvinyl pyrrolidone and copolymers of said compounds.

10. The method of claim 6 wherein said proppant is present in an amount of from about 0 pounds to about 20 pounds per gallon of emulsion.

11. A method of fracturing a subterranean formation penetrated by a well bore comprising:

admixing an aqueous liquid and a gelling agent together with varying quantities of a proppant material with liquid carbon dioxide and a selected surfactant to form an emulsion, said emulsion having an internal phase ratio of from about 50 to in excess of about 96 percent, said surfactant being present in said emulsion in an amount sufficient to substantially stabilize said emulsion and said gelling agent comprising a hydratable polymer present in an amount of from about 10 pounds to about 80 pounds per 1000 gallons of aqueous liquid and a crosslinking agent capable of crosslinking said hydratable polymer;

adjusting the volume of carbon dioxide admixed with said aqueous liquid to at least substantially maintain said internal phase ratio constant as the quantity of said proppant is varied whereby the viscosity of said emulsion is caused to remain substantially unchanged as the quantity of said proppant varies;

introducing said emulsion into said well bore penetrating said subterranean formation at a temperature below the critical temperature of carbon dioxide and under sufficient pressure to maintain the carbon dioxide as a liquid and effect at least one fracture in said formation;

heating said emulsion after entry into said well bore by heat absorbed from said formation to a temperature above the critical temperature of carbon dioxide to form a foam from said emulsion, said foam having a viscosity immediately after formation which is substantially the same as the viscosity of the emulsion; and depositing said proppant material in the fracture created in said subterranean formation with said emulsion or foam.

12. The method of claim 11 wherein said surfactant comprises at least one member selected from the group consisting of alkyl quaternary amines, betaines, sulfated or sulfonated alkoxylates, alkyl quaternary amines, alkoxylated linear alcohols, alkyl sulfonates, alkyl aryl sulfonates, $C_{10}$–$C_{20}$ alkyldiphenyl ether sulfonates and the like.

13. The method of claim 11 wherein said surfactant is present in a concentration in the range of from about 0.05 percent to about 2.0 percent by weight of the emulsion.

14. The method of claim 11 wherein said hydratable polymer comprises at least one member selected from the group consisting of guar gum and guar derivatives, locust bean gum, carrageenan gum, xanthan gum, cellulose derivatives, polyacrylates, polymethacrylates, polyacrylamides, polyvinyl pyrrolidone and copolymers of said compounds.

15. A method of fracturing a subterranean formation penetrated by a well bore comprising:

admixing an aqueous liquid containing varying quantities of a proppant material and a gelling agent with liquid carbon dioxide and a surfactant which is present in an amount sufficient to form an emulsion, said emulsion having an internal phase ratio of from about 60 to in excess of about 96 percent;

adjusting the volume of carbon dioxide admixed with said aqueous liquid to at least substantially maintain said internal phase ratio constant as the quantity of said proppant is varied whereby the viscosity of said emulsion is caused to remain substantially unchanged as the quantity of said proppant varies;

introducing said emulsion into said well bore penetrating said subterranean formation at a temperature below the critical temperature of carbon dioxide and under sufficient pressure to maintain the carbon dioxide as a liquid at the introduction temperature and to cause a fracture to be formed in said subterranean formation;

maintaining said emulsion within said formation for a sufficient time to permit said emulsion to be heated to a temperature above the critical temperature of carbon dioxide to form a foam from said emulsion, said foam having a viscosity immediately after formation which is substantially the same as the viscosity of the emulsion; and depositing at least a portion of said proppant material in said subterranean formation with said foam.

16. The method of claim 15 wherein said surfactant is present in a concentration in the range of from about 0.05 percent to about 2.0 percent by weight of the emulsion.

17. The method of claim 15 wherein said gelling agent comprises a hydratable polymer present in an amount of from about 10 pounds to about 80 pounds per 1000 gallons of aqueous fluid.

18. The method of claim 17 wherein said polymer comprises at least one member selected from the group consisting of guar gum and guar derivatives, locust bean gum, carrageenan gum, xanthan gum, cellulose derivatives, polyacrylates, polymethacrylates, polyacrylamides, polyvinyl pyrrolidone and copolymers of said compounds.

19. The method of claim 15 wherein said internal phase ratio is from about 70 to in excess of about 96 percent.

20. A method of fracturing a subterranean formation penetrated by a well bore comprising:

admixing an aqueous liquid with varying quantities of a proppant material, liquid carbon dioxide and a surfactant to form an emulsion, said emulsion having an internal phase ratio of from about 60 to in excess of about 96 percent, said surfactant being present in said emulsion in an amount sufficient to substantially stabilize said emulsion;

adjusting the quantity of liquid carbon dioxide admixed with said aqueous liquid as said quantity of proppant material varies to at least substantially maintain said internal phase ratio constant in said emulsion containing said proppant;

introducing said emulsion into said well bore penetrating said subterranean formation at a temperature below the critical temperature of carbon dioxide and under sufficient pressure to maintain the carbon dioxide as a liquid;

maintaining said emulsion within said formation for a sufficient time to permit said emulsion to be heated to a temperature above the critical temperature of carbon dioxide to form a stabilized foam from said emulsion, said foam having a viscosity immediately after formation which is substantially the same as the viscosity of the emulsion;

contacting said formation with said emulsion or foam at a pressure sufficient to create at least one fracture in said subterranean formation; and depositing said proppant material in said fracture in said subterranean formation.

21. The method of claim 20 wherein said surfactant is present in a concentration in the range of from about 0.05 percent to about 2.0 percent by weight of the emulsion.

22. The method of claim 20 wherein said gelling agent comprises a hydratable polymer present in an amount of from about 10 pounds to about 80 pounds per 1000 gallons of aqueous liquid.

23. The method of claim 20 wherein said internal phase ratio is from about 70 to in excess of about 96 percent.

24. A method of fracturing a subterranean formation penetrated by a well bore comprising:

admixing an aqueous liquid and a gelling agent together with varying quantities of a proppant material with liquid carbon dioxide and a selected surfactant to form an emulsion, said emulsion having an internal phase ratio of from about 60 to in excess of about 96 percent, said surfactant being present in said emulsion in an amount sufficient to substantially stabilize said emulsion and said gelling agent comprising a hydratable polymer present in an amount of from about 10 pounds to about 80 pounds per 1000 gallons of aqueous liquid and a crosslinking agent capable of crosslinking said hydratable polymer;

adjusting the volume of carbon dioxide admixed with said aqueous liquid to at least substantially maintain said internal phase ratio constant as the quantity of said proppant is varied whereby the viscosity of said emulsion is caused to remain substantially unchanged as the quantity of said proppant varies;

introducing said emulsion into said well bore penetrating said subterranean formation at a temperature below the critical temperature of carbon dioxide and under sufficient pressure to maintain the carbon dioxide as a liquid at the introduction temperature and effect at least one fracture in said formation;

heating said emulsion after entry into said well bore by heat absorbed from said formation to a temperature above the critical temperature of carbon dioxide to form a foam from said emulsion, said foam having a viscosity immediately after formation which is substantially the same as the viscosity of the emulsion; and depositing said proppant material in the fracture created in said subterranean formation with said emulsion or foam.

25. The method of claim 24 wherein said surfactant comprises at least one member selected from the group consisting of alkyl quaternary amines, betaines, sulfated or sulfonated alkoxylates, alkyl quaternary amines, alkoxylated linear alcohols, alkyl sulfonates, alkyl aryl sulfonates, $C_{10}$–$C_{20}$ alkyldiphenyl ether sulfonates and the like.

26. The method of claim 24 wherein said surfactant is present in a concentration in the range of from about 0.05 percent to about 2.0 percent by weight of the emulsion.

27. The method of claim 24 wherein said hydratable polymer comprises at least one member selected from the group consisting of guar gum and guar derivatives, locust bean gum, carrageenan gum, xanthan gum, cellulose derivatives, polyacrylates, polymethacrylates, polyacrylamides, polyvinyl pyrrolidone and copolymers of said compounds.

28. The method of claim 24 wherein said internal phase ratio is from about 70 to in excess of about 96 percent.

29. A method of fracturing a subterranean formation having a temperature above the critical temperature of carbon dioxide and penetrated by a well bore comprising:

admixing an aqueous liquid, a gelling agent and varying quantities of a proppant material with liquid carbon dioxide and a surfactant to form an emulsion having an internal phase and an external phase, said emulsion having an internal phase ratio of from about 60 to in excess of about 96 percent, adjusting the volume of carbon dioxide admixed with said aqueous liquid as the quantity of said proppant is varied to at least substantially maintain constant the ratio of the total volume of the internal phase of the emulsion to the total volume of the emulsion comprising both the internal and external phases;

introducing said emulsion into said well bore penetrating said subterranean formation at a temperature below the critical temperature of carbon dioxide and a sufficient pressure to maintain the carbon dioxide as a liquid;

heating said emulsion after entry into said well bore by heat absorbed from said formation to a temperature above the critical temperature of carbon dioxide to form a foam from said emulsion, said foam having a viscosity immediately after formation which is substantially the same as the viscosity of said emulsion;

contacting said formation with said emulsion or foam at a pressure sufficient to create at least one fracture in said formation; and depositing proppant material in said fracture in said subterranean formation.

30. The method of claim 29 wherein said surfactant is present in a concentration in the range of from about 0.05 percent to about 2.0 percent by weight of the emulsion.

31. The method of claim 29 wherein said gelling agent comprises a hydratable polymer present in an amount of from about 10 pounds to about 80 pounds per 1000 gallons of aqueous fluid.

32. The method of claim 29 wherein said polymer comprises at least one member selected from the group consisting of guar gum and guar derivatives, locust bean gum, carrageenan gum, xanthan gum, cellulose derivatives, polyacrylates, polymethacrylates, polyacrylamides, polyvinyl pyrrolidone and copolymers of said compounds.

* * * * *